US012736215B2

(12) United States Patent
Alshahrani et al.

(10) Patent No.: US 12,736,215 B2
(45) Date of Patent: Sep. 15, 2026

(54) INDUCED DRAFTING IN PROCESS HEATERS

(71) Applicant: SAUDI ARABIAN OIL COMPANY, Dhahran (SA)

(72) Inventors: Mogib M. Alshahrani, Tanajib (SA); Nasir Yasir N. Alqusair, Tanajib (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 384 days.

(21) Appl. No.: 18/543,565

(22) Filed: Dec. 18, 2023

(65) Prior Publication Data

US 2025/0198614 A1 Jun. 19, 2025

(51) Int. Cl.
*F22B 1/18* (2006.01)

(52) U.S. Cl.
CPC ..... *F22B 1/1861* (2013.01)

(58) Field of Classification Search
CPC ..... F22B 1/18; F22B 1/1861
See application file for complete search history.

(56) References Cited

U.S. PATENT DOCUMENTS

| | | | | |
|---|---|---|---|---|
| 1,857,364 A | | 5/1932 | De Rachat | |
| 2,336,833 A | | 12/1943 | Phillips | |
| 2,753,925 A | | 7/1956 | Campbell et al. | |
| 4,301,662 A | * | 11/1981 | Whitnah | F25B 1/08 62/238.4 |
| 5,647,221 A | * | 7/1997 | Garris, Jr. | F04F 5/462 417/179 |
| 8,361,397 B2 | * | 1/2013 | Farmayan | C01B 13/02 252/186.1 |
| 10,429,067 B2 | | 10/2019 | Salu et al. | |
| 2009/0014689 A1 | * | 1/2009 | Klepper | C10K 1/101 422/198 |
| 2011/0017584 A1 | * | 1/2011 | Stevenson | B01D 5/006 239/371 |

FOREIGN PATENT DOCUMENTS

| | | | | |
|---|---|---|---|---|
| CN | 202915556 U | * | 5/2013 | F25B 25/02 |
| CN | 203772053 U | | 8/2014 | |
| CN | 106765049 A | * | 5/2017 | F04F 5/16 |
| CN | 109870038 A | * | 6/2019 | |
| CN | 209558305 U | | 10/2019 | |
| CN | 214836581 U | | 11/2021 | |
| FR | 2721689 A1 | * | 12/1995 | F23G 5/10 |

* cited by examiner

*Primary Examiner* — Gregory A Wilson
(74) *Attorney, Agent, or Firm* — Vorys, Sater, Seymour and Pease LLP

(57) ABSTRACT

A method includes initiating operation of a heat source within a process heater for providing a heat load and generating heated flue gases, generating steam within a heat exchanger via the heated flue gases and cooling the heated flue gases into cooled flue gases, and inducing a draft within the process heater by injecting the steam through an ejector fluidly coupled to the process heater above or after the heat exchanger to receive the cooled flue gases.

15 Claims, 4 Drawing Sheets

INDUCED DRAFTING IN PROCESS HEATERS

FIELD OF THE DISCLOSURE

The present disclosure relates generally to process heaters and, more particularly, to methods and systems of generating an induced draft in process heaters.

BACKGROUND OF THE DISCLOSURE

For refining, distilling, and chemically reactive processes, heat may be utilized for starting or continuing the process of interest. Accordingly, a heater, such as a furnace, may provide heat to enable a chemical reaction or otherwise facilitate the process. Heat may be extracted from these process heaters from both a radiative section near the heaters, and a convective section below or within an exhaust stack. The convective section may be used for steam generation and may extract heat from hot flue gases flowing through the stack. The flue gases may be drawn through the stack by a natural draft caused by a temperature difference between the interior of the heater and the outside air. Additionally, a forced draft may be provided by fans or blowers to drive the flow of flue gasses through the convective section. To control the flow of flue gases, and thus the production of steam, the natural draft and the forced draft may be regulated e.g., by opening and closing dampers in the stack and/or controlling a speed of the fans or blowers.

However, natural drafts may be unstable for both generation and control, and forced drafts from fans increases power consumption of the process heater. Additionally, if there are no active uses for generated steam from the convective section, the steam may have a low utilization rate and may be wasted or vented. Further, the flue gases flowing out of the stack and released into the air commonly contain carbon dioxide from the heating process, and may further include one or more nitrous-oxide (NOx) compounds mixed therein, which can lead to environmental damage and health issues. As such, the operation of process heaters can include multiple challenges relating to air flow, wasted steam, and introducing contaminants into the atmosphere.

Accordingly, methods and systems for generating and controlling a forced draft in a process heater via generated steam are desirable.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a system includes a process heater housing defining a radiative heating section, a convective section above or after the radiative heating section and a stack section above or after the convective section, a heat source disposed within the radiative heating section for providing a heat load to a process, the heat source operable to generate heated flue gases, a heat exchanger mounted within the convective section above the heat source, the heat exchanger operable to generate steam via the heated flue gases and to thereby create cooled flue gases in the stack section, a steam line extending from the heat exchanger and operable to carry steam generated within the heat exchanger, and an ejector in fluid communication with both the steam line and stack section. The ejector includes an intake section including a vacuum intake in fluid communication with the stack section, and an intake nozzle in fluid communication with the steam line to increase a velocity of the steam received in the intake section, wherein the increased velocity of the steam generates a vacuum within the vacuum intake to induce a draft within the stack section.

In a further embodiment, a method includes initiating operation of a heat source within a process heater for providing a heat load and generating heated flue gases, generating steam within a heat exchanger via the heated flue gases and cooling the heated flue gases into cooled flue gases, and inducing a draft within the process heater by injecting the steam through an ejector fluidly coupled to the process heater above the heat exchanger to receive the cooled flue gases.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
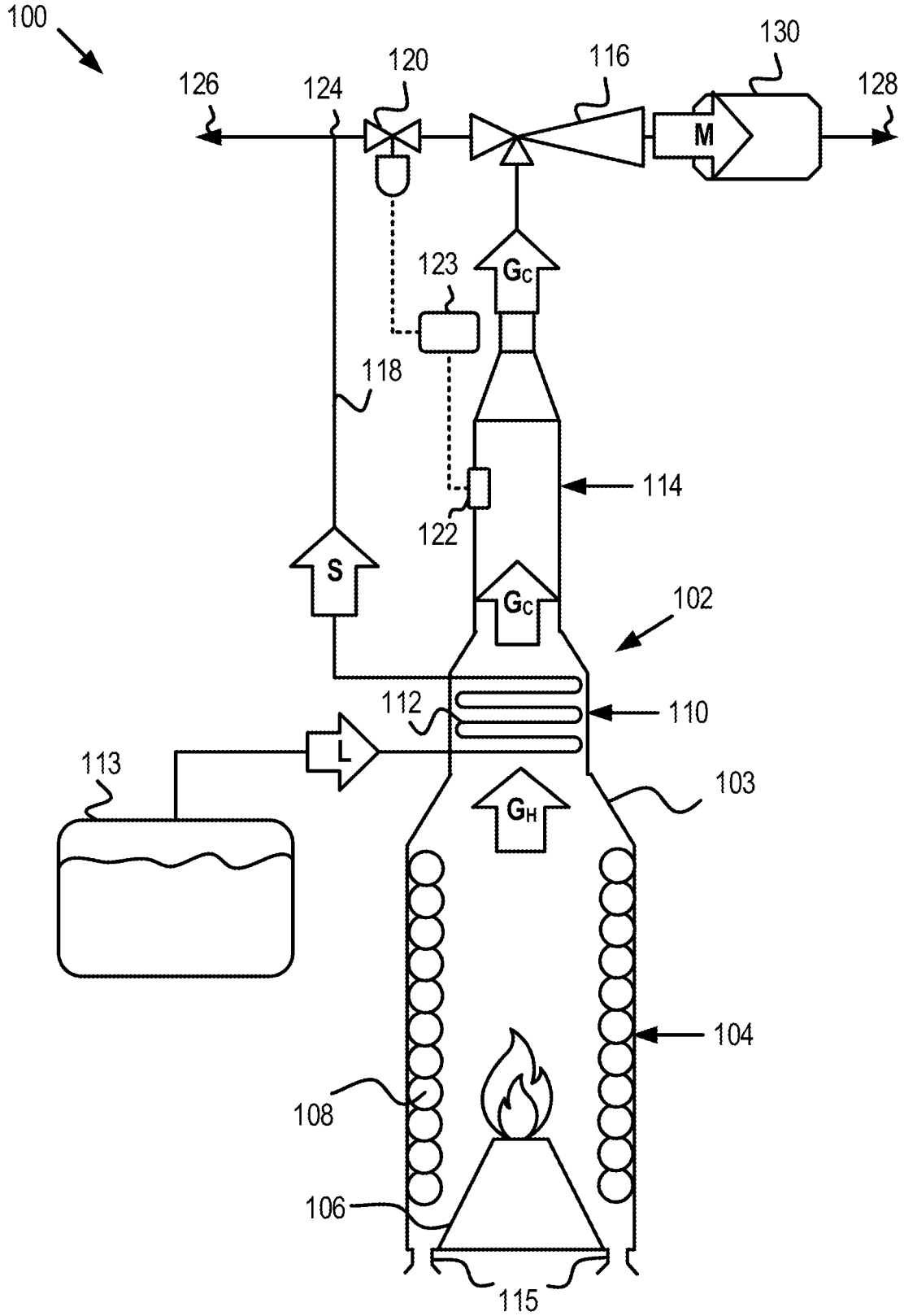
FIG. 1 is a schematic diagram of a heater system using steam to induce a draft in accordance with one or more embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to process heaters and, more particularly, to methods and systems of generating an induced draft in process heaters. The embodiments disclosed herein may include a process heater in which a radiative section and a convective section are defined. Flue gases may be vented through the convective section to a stack section of the process heater. Steam may be generated within a heat exchanger in the convective section by drawing heat from the heated flue gases, which are thereby turned into cooled flue gases. The generated steam and the cooled flue gases may be mixed and expelled via an ejector mounted atop the stack section. The ejector may create a vacuum to induce a draft within the process heater, which may facilitate proper firing of a burner or other heat source therein. The steam may be controlled via a control valve and connected oxygen sensor, such that optimal oxygenation conditions may be maintained within the system. The disclosed embodiments may enable self-sustaining draft generation without the use of powered fans. Further, the disclosed embodiments may reduce emitted nitrous oxides (NOx) while further increasing utilization of generated steam.

FIG. 1 is a schematic diagram of a heater system 100 which incorporates one or more embodiments of the present disclosure. The heater system 100 includes a process heater 102, which in some embodiments, may be a furnace, direct-fired heater, fire tube heater, or any other heater capable of providing a sufficient heat duty to the process of interest. The process heater 102 includes a process heater housing 103, which may define a radiative heating section 104 in which a burner 106 or other heat source is installed. The burner 106 may generate heat by combusting a fuel such as oil, natural gas, and/or coal. The heat produced by the burner 106 or other heat source may be transferred to a process fluid circulated through the radiative heating section 104. The process fluid may be circulated through a flowpath 108, which, as shown in the illustrated embodiment, may include a length of coiled piping circumscribing the burner 106. The process fluid may be circulated from the flowpath 108 to any destination where the heat may be employed to facilitate or otherwise enable the process of interest, e.g., refining, distilling, or a chemical reaction. Such destinations may include charge heaters and reboilers, as well as hydrotreaters and reformers for reaction temperature control. In other embodiments, the reaction may occur directly within a flowpath 108 that is positioned within the radiative heating section 104.

The process heater 102 may further include a convective heating section 110 positioned above or after the radiative heating section 104. The process heater 102 is illustrated in a vertical orientation in which heat and fluids rise through the process heater. In other embodiments, process heaters in other orientations are contemplated such that features illustrated "above" other reference features in the process heater 102 may instead be positioned "after" or downstream of the reference features. The convective heating section 110 may receive hot flue gases "$G_H$" rising from the radiative heating section 104. The convective heating section 110 may include a heat exchanger 112 therein for steam conversion or to facilitate another process of interest. In the illustrated embodiment, the heat exchanger 112 receives liquid water "L" from a water source 113 and utilizes the heat from the hot flue gases $G_H$ to convert the liquid water L into steam "S". A portion of the steam S may flow out of the heat exchanger 112 and through a steam output line 126 for use in further processes or for external use. As the heat of the hot flue gases $G_H$ is transferred to the heat exchanger 112 to generate steam S, the flue gasses are cooled, and cooled flue gases "$G_C$" may flow out of the convective heating section 110.

The process heater 102 may further include a stack section 114 above or after the convective heating section 110 which may allow the cooled flue gases $G_C$ to exit the heater system 100 into the atmosphere. The flow of cooled flue gases $G_C$ out of the stack section 114 may generate a natural draft through the process heater 102. To promote constant flow, and to perpetuate the cycling of flue gases through the process heater 102, one or more vents 115 may be provided at a lower end of the radiative heating section where air may be drawn into the process heater by the natural draft. In other embodiments, powered fans (not shown) may be utilized for a forced draft generation to supplement the natural drafting through the process heater 102.

In the illustrated embodiment, the stack section 114 may be in fluid communication with an ejector 116. The ejector 116 may be an aspirator, steam jet ejector, or other vacuum ejector which utilizes a working fluid to generate a vacuum as the working fluid flows across the ejector 116. In the illustrated embodiment, the ejector 116 may be in fluid communication with a steam line 118 extending from the heat exchanger 112 such that steam S generated by the heat exchanger 112 may be provided to the ejector 116 as the working fluid. The steam line 118 may include a control valve 120 which may enable selective control of the flow of steam S into the ejector 116 as desired.

The control valve 120 may be in communication with an oxygen sensor 122 mounted on or within the stack section 114. The oxygen sensor 122 may monitor the oxygen concentration within the stack section 114 that can be found within the cooled flue gases $G_C$. The oxygen sensor 122 may be in communication with a controller 123 that is operable to compare the measured oxygen concentration to an upper and lower threshold. The controller 123 can determine if the measured oxygen concentration is outside of the desired range, and may be in further communication with the control valve 120. Accordingly, if the oxygen concentration within the stack section 114 is lower than optimal levels, the controller 123 may provide a signal to the control valve 120 to open or open further (i.e., to a greater degree). The control valve 120 may then enable the flow of steam S to the ejector 116 to increase vacuum within the stack section 114 for inducing additional draft through the process heater. Conversely, if a higher than optimal oxygen concentration is detected by the oxygen sensor 122, the controller 123 may provide a signal to close the control valve 120. The control valve 120 may then close or limit flow therethrough to the ejector 116 to prevent flaming out of the burner 106. Accordingly, through the combination of the oxygen sensor 122, the controller 123, and the control valve 120, optimal drafting may be maintained within the process heater 102.

In some embodiments, the controller 123 may be a computer-based system that may include a processor, a memory storage device, and programs and instructions stored on the memory storage device and accessible by the processor for executing the instructions utilizing the data stored in the memory storage device. In other embodiments, the controller 123 may include manual controls that may be manipulated by an operator to control any of the procedures and equipment described herein.

As indicated above, the steam line 118 may be in fluid communication with the heat exchanger 112 to use a portion of the steam S generated therein as the working fluid for the ejector 116. The steam line 118, e.g., the outlet line of the heat exchanger 112, may be connected at a junction 124 to the steam output line 126. The junction 124 may receive the steam S from the heat exchanger 112 as an input, and may permit the steam S to either continue along the steam line 118 through the control valve 120 and/or to exit the system 100 through the steam output line 126. The steam output line 126 may enable flow of the generated steam S to external components for use in further processes, as discussed above. Accordingly, when the control valve 120 is closed, the steam S generated within the heat exchanger 112 may continue to flow out of the system 100, and when the control valve 120 is opened, a portion of the steam S may flow through the ejector 116 for generating an induced draft in the process heater 102. In this way, the system 100 may enable increased utilization of the steam S generated therein, as it is used for both draft generation and external processes or storage.

The steam S passes through the ejector 116 to induce a draft within the stack section 114, and mixes with the cooled flue gas $G_C$, following which it is expelled from the ejector 116 in a mixture "M" of steam and flue gases. This mixture M may reduce the harmful effects of NOx, as the combination of water (or steam S) and the cooled flue gases $G_C$ may reduce NOx emissions from the overall system 100. The mixture M may exit the ejector 116 into a transport line 128 which may transport the mixture M to a desired external location. In some embodiments, the transport line 128 may transport the mixture M to a wetlands location where the mixture M may be reintroduced to the atmosphere with limited environmental impact. In further embodiments, however, the transport line 128 may transport the mixture M to a marine cultivation or aquaculture location for use in further applications.

A cooler 130 may be arranged in the transport line 128 to enable further cooling of the mixture M. In some embodiments, the cooler 130 may be a condenser which enables conversion of the gaseous mixture M into a liquid form for easier reuse and transport. Accordingly, the system 100 may generate and regulate drafting through the process heater 102 without power consumption on the scale of powered fans, may increase utilization of the generated steam S, and may limit NOx emissions through the mixture M of the steam S and cooled flue gases $G_C$.

The operation of the heater system 100 may be self-sustaining following startup, as the generated steam S may be used to induce a draft that sustains a flame at the burners 106. However, in some instances, difficulties may arise during the system startup due to a limited availability of steam S for an initial draft generation. Accordingly, in the heater system 300 (FIG. 3), a startup system 302 may provide initial steam $S_I$ for initiating the drafting until self-sustaining operation may be achieved.

Figure 2:
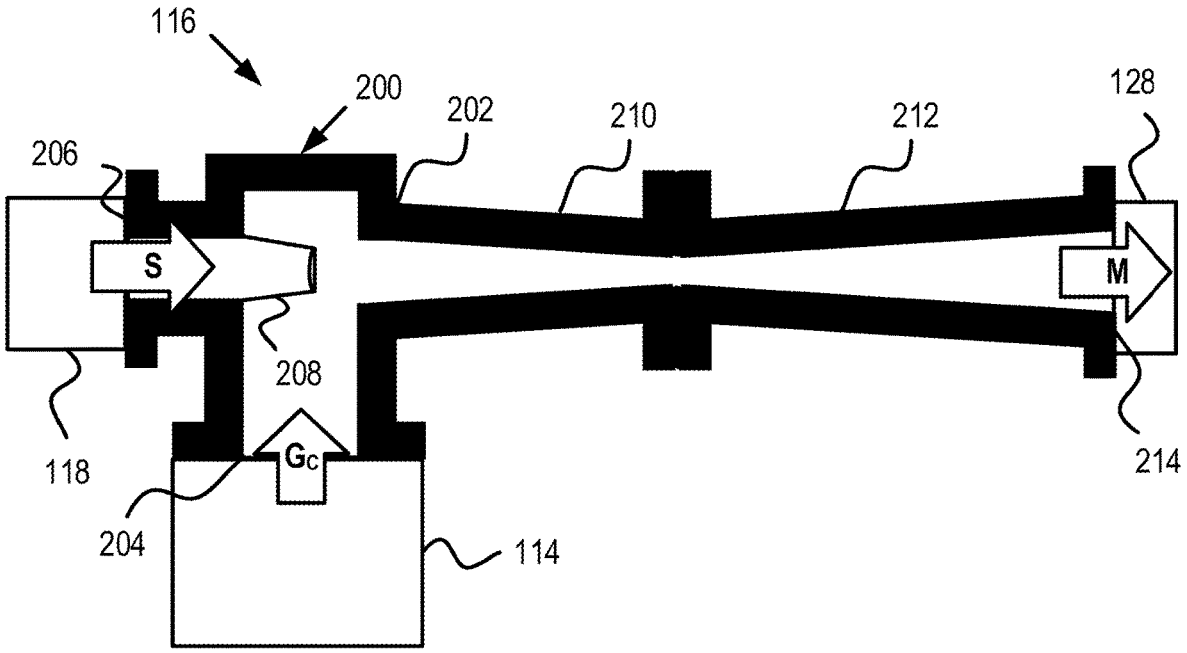
FIG. 2 is a schematic diagram of an ejector of the heater system of FIG. 1.

FIG. 2 is a schematic sectional diagram of the ejector 116 according to one or more embodiments of the present disclosure. The ejector 116 may include a body 200 that may further include multiple interior sections for receiving and manipulating fluid flows. The body 200 may include an intake section 202 which can receive the cooled flue gases $G_C$ through a vacuum intake 204. In the illustrated embodiment, the vacuum intake 204 may be mated atop the stack section 114, as discussed above. The intake section 202 may further receive steam S via a motive fluid intake 206 that may be mated with the steam line 118. The intake section 202 may include an intake nozzle 208 at or near the motive fluid intake 206, such that the steam S may enter the intake section 202 at a high velocity. The high velocity of the steam S through the intake nozzle 208 may reduce pressure within the intake section 202, and the reduced pressure may generate a vacuum that draws in cooled flue gases $G_C$ flow into the vacuum intake 204 and towards the lower pressure area within the intake section 202. The entry of the cooled flue gases $G_C$ into the vacuum intake 204 may accordingly induce a draft within the process heater 102 and encourage further flow.

The high-velocity steam S and the cooled flue gases $G_C$ flow into a mixing section 210, which itself may be a converging nozzle. The mixing section 210 may enable mixing of the steam S and cooled flue gases $G_C$ while maintaining or increasing an overall velocity of a generated mixture "M". The generated mixture M may flow into an expansion section 212, which itself may be a diverging diffuser. The expansion section 212 may enable slowing and expansion of the mixture M to reduce pressure towards environmental pressure. The mixture M may be received at an outlet 214 of the ejector 116, such that the mixture M may exit the ejector 116. In the illustrated embodiment, the outlet 214 may be mated to, or otherwise in fluid communication with, the transport line 128 for further transport.

Figure 3:
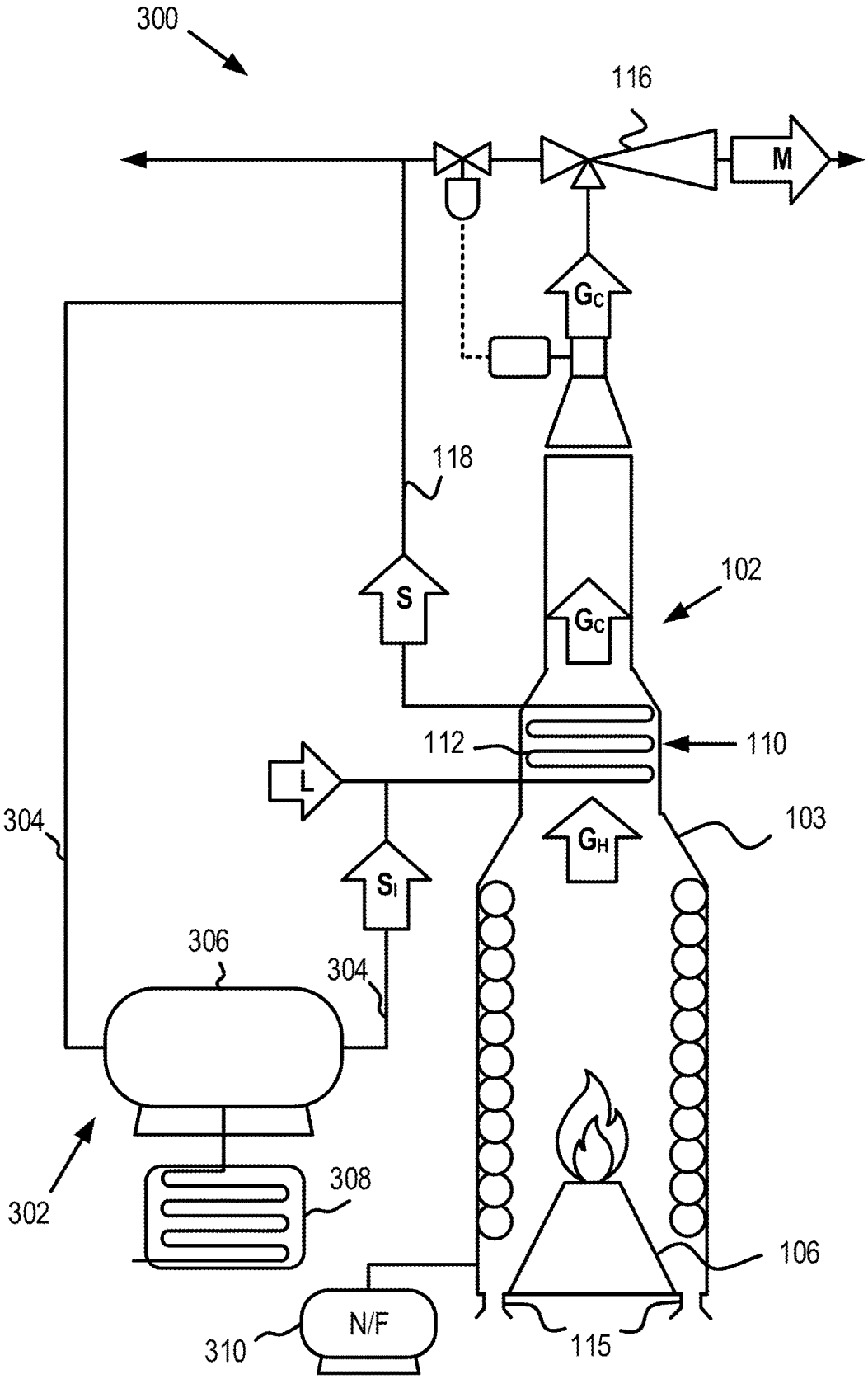
FIG. 3 is a schematic diagram of a heater system with a startup system, according to one or more embodiments of the present disclosure.

FIG. 3 is a schematic diagram of a heater system 300 with a startup system 302, according to one or more embodiments of the present disclosure. The startup system 302 is operably coupled to the process heater 102, and may include a steam inlet line 304 in fluid communication with the heat exchanger 112 or the steam line 118. The steam inlet line 304 may thus provide initial steam $S_I$ to the ejector 116 prior to the initiation of steam generation in the heat exchanger 112. In some embodiments, the steam inlet line 304 may be in fluid communication with a steam tank 306 or another source of initial steam $S_I$. The steam tank 306 may be charged with initial steam $S_I$ from a system for another process (not shown) or another externally generated source. In further embodiments, either the steam inlet line 304 or the steam tank 306 may be in fluid communication with a steam generator 308. The steam generator 308, as illustrated, may be a heat exchanger with a separate heat source (not shown), which may generate steam externally from the process heater 106 or convective heating section 110. The steam generator 308 may be utilized during startup of the system 300 using an external or incorporated power source to provide the initial steam $S_I$ to induce an initial draft as operation of the process heater 102 in the system 300 is started.

Additionally or alternatively, the startup system 302 may include a source 310 of nitrogen "N" and/or fuel gas "F", which may be injected into the process heater 102 near the burners 106 during start up. The injection of the nitrogen "N" and/or fuel gas "F" may assist in maintaining a flame at the burners 106 and may force a draft through the process heater 102 until steam production by the heat exchanger 112 is sufficient to induce a draft at the ejector 116.

Figure 4:
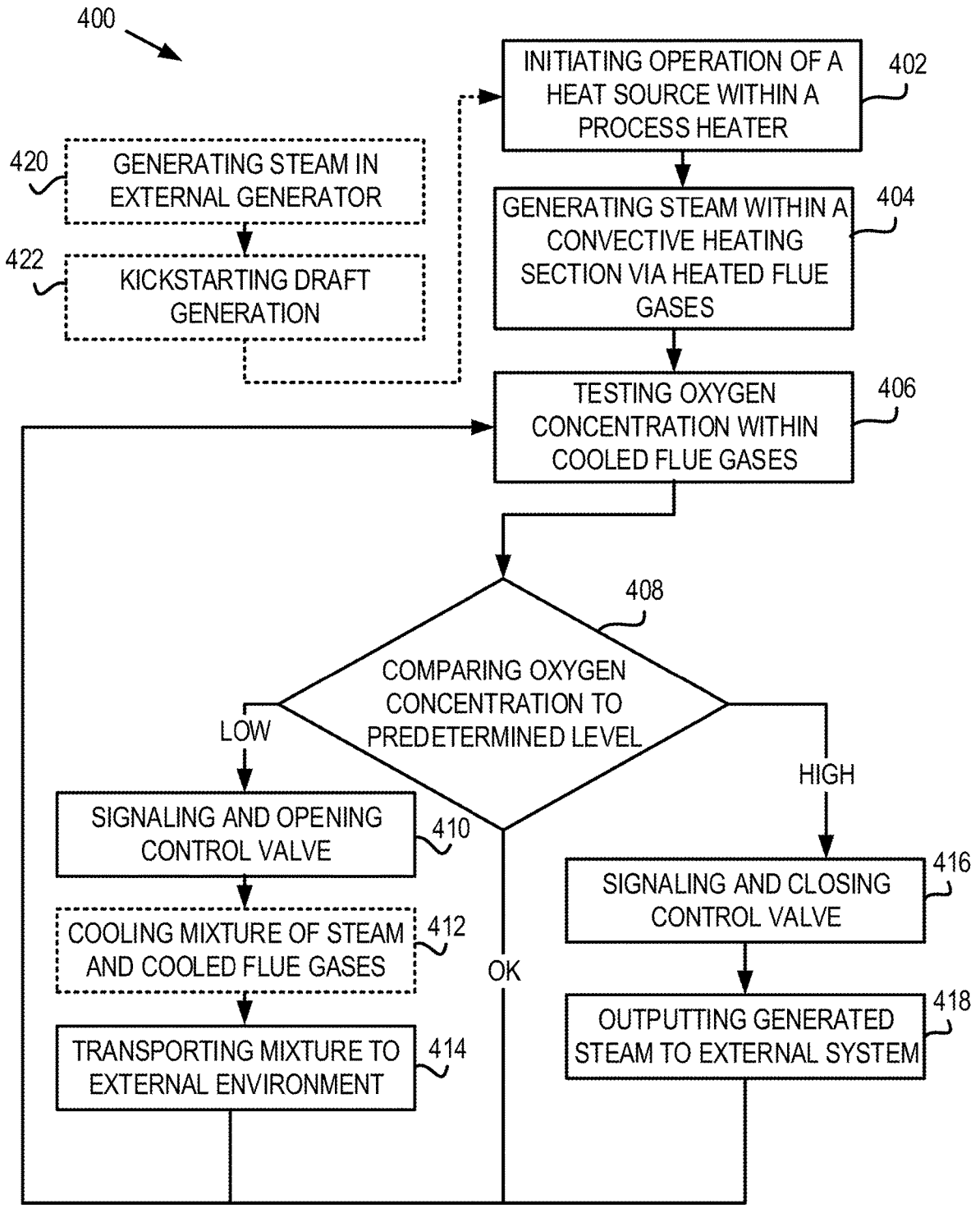
FIG. 4 is a schematic flowchart of a method for self-sustaining draft generation in a heater system.

FIG. 4 is a schematic flowchart of an example method 400 for self-sustaining draft generation in a heater system (e.g., the heater system 100 or 300, of FIGS. 1 and 3). The method 400 may begin at 402 with initiating operation of a heat source (e.g., the burners 106) within a process heater (e.g., the process heater 102). The heat source of the process heater may be initiated at 402 to begin radiative heating within a radiative heating section (e.g., the radiative heating section 104). The heat source may provide heat to facilitate a physical separation process, reactive process etc., and heated flue gases (e.g., the heated flue gases $G_H$) may flow into a convective heating section (e.g., the convective heating section 110) within the process heater.

Accordingly, the method 400 may include generating steam (e.g., the steam S) within the convective heating section at 404. The steam may be generated within a heat exchanger (e.g. the heat exchanger 112) within the convective heating section. The heat exchanger may include liquid water therein, and the heat applied within the convective heating section may convert the liquid water to steam during travel through the heat exchanger. The steam may flow out of the heat exchanger, while the previously heated flue gases may flow into a stack section (e.g. the stack section 114) as cooled flue gases (e.g., the cooled flue gases $G_C$).

At 406, the method 400 may include testing oxygen concentration within the cooled flue gases via an oxygen sensor (e.g., the oxygen sensor 122). The oxygen sensor may be in fluid communication with, or may be installed within, the stack section of the process heater. Further, at 408, the method 400 may include determining, via a controller (e.g., the controller 123) whether the oxygen concentration is within desired levels, or whether the oxygen concentration is out of the desired levels. If the oxygen concentration is within desired levels at 408, the method may continue at 406 with continued operation and monitoring of the system without modifications.

If the oxygen concentration at 408 is determined to be too low, the method 400 may continue at 410 with signaling and opening a control valve (e.g., the control valve 120) to enable steam flow to an ejector (e.g., the ejector 116). The flow of steam to the ejector through the control valve at 410 may induce a draft in the stack section to which the ejector is in fluid communication. Accordingly, the steam may flow through the ejector and mix with the cooled flue gases to form a mixture (e.g., the mixture M) with reduced NOx emissions. In some embodiments, the method 400 may include cooling of the steam and cooled flue gas mixture at 412. Cooling of the mixture at 412 may enable condensation of the mixture into a liquid form for easier recycling and transport. The method 400 may then continue at 414 with transporting the mixture of steam and cooled flue gases to an external environment. As the mixture exits the ejector, it may be transported at 414 to a wetlands environment or to an aquaculture location for further use and recycling. The method 400 may then continue at 406 with continued operation and monitoring of the system.

Alternately, if the oxygen concentration at 408 is determined to be too high, the method 400 may continue at 416 with signaling and closing of the control valve. Closing of the control valve may route generated steam away from the ejector and towards a steam output line (e.g., the steam output line 126). Without the flow of steam across the ejector at 416, flaming out of the process heater may be avoided as the drafting within the stack section and structure are reduced. The method 400 may continue at 418 with outputting the generated steam through the steam output line 126 to external systems. The outputting of the generated steam at 418 may enable the use of the generated steam for external processes outside of the heater system. The method 400 may then continue at 406 with continued operation and monitoring of the system, until a determination is made at 408 that the oxygen concentration is outside of desired levels.

In some embodiments, the method 400 may include generating steam in an external steam generator (e.g., the steam generator 308) at 420. The generation of steam in the external steam generator at 420 may enable draft generation within the heater system without an operating heat source. Accordingly, the method 400 may include kickstarting draft generation of the heater system via the externally generated steam at 422. As the heater system utilizes steam to generate a draft for the process heater, and the heat exchanger uses heat from the process heater to generate steam, an initial steam insertion may be utilized for beginning self-sustaining operation of the heater system. Thus, the method 400 may then continue at 402 with initiation of the process heater such that a draft may be generated and controlled during the entire operation of the process heater. Once steam is generated at 404 in the convective heating section, the external steam generator may be powered off, or excess steam may be stored in a steam tank (e.g., the steam tank 306) for later use.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A system, comprising:

a process heater housing defining a radiative heating section, a convective section above or after the radiative heating section, and a stack section above or after the convective section;

a heat source disposed within the radiative heating section for providing a heat load to a process, the heat source being operable to generate heated flue gases;

a heat exchanger mounted within the convective section above or after the heat source, the heat exchanger being operable to generate steam via the heated flue gases and thereby create cooled flue gases in the stack section;

a steam line extending from the heat exchanger and operable to carry steam generated within the heat exchanger; and an ejector in fluid communication with both the steam line and stack section, the ejector including:

an intake section including a vacuum intake in fluid communication with the stack section; and an intake nozzle in fluid communication with the steam line to increase a velocity of the steam received in the intake section, wherein the increased velocity of the steam generates a vacuum within the vacuum intake to induce a draft within the stack section.

2. The system of claim 1, further comprising:

an oxygen sensor operable to monitor an oxygen concentration within the cooled flue gases; and a control valve in communication with the oxygen sensor and operable to control a flow of steam into the ejector based on the oxygen concentration.

3. The system of claim 2, further comprising a controller in communication with the oxygen sensor and the control valve, the controller being operable to compare the oxygen concentration to an upper threshold and a lower threshold, and to generate a signal for actuation of the control valve based on the oxygen concentration with respect to the upper and lower threshold.

4. The system of claim 1, wherein the control valve is in further fluid communication with a steam output line for providing generated steam to an external system.

5. The system of claim 1, wherein the ejector further includes a mixing section downstream of the vacuum intake and the intake nozzle, the mixing section including a converging nozzle that creates a mixture of the steam and the cooled flue gases.

6. The system of claim 5, further comprising a transport line fluidly coupled to an outlet of the ejector for transporting the mixture to an external location.

7. The system of claim 6, further comprising a cooler mounted on the transport line for cooling the mixture.

8. The system of claim 1, further comprising:

an external steam generator for producing initial steam prior to operation of the process heater; and a steam input line in fluid communication with the external steam generator and the ejector.

9. A method, comprising:

initiating operation of a heat source within a process heater for providing a heat load and generating heated flue gases;

generating steam within a heat exchanger via the heated flue gases and cooling the heated flue gases into cooled flue gases;

directing the steam through an ejector fluidly coupled to a stack section of the process heater above or after the heat exchanger;

increasing a velocity of the steam through the ejector via an intake nozzle in an intake section of the ejector; and generating a vacuum, via the increased velocity of the steam, within a vacuum intake of the intake section in fluid communication with the stack section, thereby drawing the cooled flue gases from the stack section into the ejector to induce a draft within the process heater.

10. The method of claim 9, further comprising:

testing an oxygen concentration of the cooled flue gases via an oxygen sensor above or after the heat exchanger; and signaling, via a controller, a control valve in fluid communication with the heat exchanger to open when the oxygen concentration is lower than a predetermined range.

11. The method of claim 10, further comprising signaling, via the controller, the control valve to close when the oxygen concentration is greater than a predetermined range.

12. The method of claim 9, further comprising transporting a mixture of the steam and the cooled flue gases to an external location via a transport line.

13. The method of claim 12, further comprising cooling the mixture via a cooler on the transport line for condensing the mixture into a liquid form.

14. The method of claim 12, further comprising outputting a portion of the steam through a steam output line to an external system.

15. The method of claim 9, further comprising:

generating initial steam via an external steam generator;

transporting the initial steam to the ejector; and kickstarting draft generation above or after the process heater prior via the initial steam prior to initiating operation of the heat source of the process heater.

* * * * *